US007472933B2

(12) United States Patent
Weedon et al.

(10) Patent No.: US 7,472,933 B2
(45) Date of Patent: Jan. 6, 2009

(54) SECURITY SEAL

(75) Inventors: Derrick Weedon, London (GB); Christopher Benning, Kent (GB)

(73) Assignee: ITW Limited, Berkshire (GB)

( * ) Notice: Subject to any disclaimer, the term of this patent is extended or adjusted under 35 U.S.C. 154(b) by 264 days.

(21) Appl. No.: 11/062,580

(22) Filed: Feb. 23, 2005

(65) Prior Publication Data

US 2006/0131895 A1 Jun. 22, 2006

(30) Foreign Application Priority Data

Dec. 16, 2004 (EP) ..... 04257828

(51) Int. Cl.
*B65D 27/30* (2006.01)

(52) U.S. Cl. ..... 292/307 A; 292/315; 292/307 R

(58) Field of Classification Search ..... 292/307 R, 292/307 A, 315
See application file for complete search history.

(56) References Cited

U.S. PATENT DOCUMENTS

| | | | | | |
|---|---|---|---|---|---|
| 569,387 | A * | 10/1896 | Pond | 292/328 |
| 1,313,270 | A * | 8/1919 | Daggs | 292/330 |
| 1,943,988 | A * | 1/1934 | Peake | 292/330 |
| 1,999,718 | A * | 4/1935 | Brooks | 292/328 |
| 2,006,051 | A * | 6/1935 | Keidel | 292/328 |
| 2,809,065 | A * | 10/1957 | Erke | 292/307 R |
| 4,299,417 | A * | 11/1981 | McClure | 292/320 |
| 4,500,124 | A * | 2/1985 | Swift | 292/318 |
| 4,681,355 | A | 7/1987 | Brammall et al. | |
| 5,402,958 | A * | 4/1995 | Mahaney | 242/388.1 |
| 6,155,617 | A * | 12/2000 | Kuenzel | 292/318 |
| D436,834 | S | 1/2001 | Aichmann | |
| 6,409,237 | B1 * | 6/2002 | Olshausen | 292/307 A |
| 6,578,886 | B1 * | 6/2003 | Bystry et al. | 292/307 R |
| 6,719,335 | B2 * | 4/2004 | Velschou et al. | 292/307 R |
| 6,749,235 | B1 | 6/2004 | Crisp | |
| 2004/0061340 | A1 | 4/2004 | Debrody et al. | |

FOREIGN PATENT DOCUMENTS

| | | |
|---|---|---|
| EP | 0 223 905 A | 6/1987 |

(Continued)

*Primary Examiner*—Gary Estremsky
(74) *Attorney, Agent, or Firm*—Lowe, Hauptman, Ham & Berner, LLP

(57) ABSTRACT

A seal of the type includes a housing and a J- or U-shaped hasp, the housing having first and second openings to receive the legs of the hasp. The first opening communicating with a third opening of the housing to form a channel for a first leg of the hasp. A locking mechanism is provided within the housing which is biased to resist withdrawal of the first leg of the hasp through the first opening. The hasp being lockable within the housing such that it can only be removed by cutting of the first leg of the hasp. The legs of the hasp are substantially rigid and are connected together by a resilient hinge such that in a first, relaxed position the legs adopt a position in which they are not parallel, the legs being moveable to a second, parallel position against the resilient force of the hinge for insertion into the housing. The housing may be formed of a main body and a cover, the cover being sealed onto the body part, the cover having at least one protrusion which engages in a corresponding recess within the body part, and the protrusion having an aperture therethrough which in use receives one leg of the hasp.

15 Claims, 4 Drawing Sheets

FOREIGN PATENT DOCUMENTS

| | | |
|---|---|---|
| EP | 0915448 A2 | 5/1999 |
| EP | 1 085 488 | 3/2001 |
| FR | 2 801 407 | 5/2001 |
| GB | 2 042 424 | 9/1980 |
| WO | 97/48603 | 12/1997 |

* cited by examiner

SECURITY SEAL

RELATED APPLICATIONS

The present application is based on, and claims priority from, European Application Number 04 257 828.6, filed Dec. 16, 2004, the disclosure of which is hereby incorporated by reference herein in its entirety.

FIELD OF THE INVENTION

The present invention relates to a security seal of the padlock type. The seal has a housing which can receive the legs of a U- or J-shaped hasp. The hasp can be broken and removed from the housing, allowing the seal to be reused with a new hasp.

BACKGROUND OF THE INVENTION

EP-A-0223905 discloses a padlock-type seal which comprises a plastic housing having a pair of apertures for receiving a shackle formed of a U-shaped piece of wire. The shackle can be passed over the member to be locked and pushed into the housing, to irreversibly lock therein. The seal is released by cutting of the wire. This particular seal cannot be reused.

U.S. Pat. No. 5,230,541 discloses a seal which is in the form of a fastener for cabinets. The fastener is closed by means of a flexible, elongated band which engages on first and second latches within the fastener body. The band can be released for reuse.

WO-A-97/48603 discloses a seal having a J-shaped hasp which may be locked in the seal housing by means of a pressure sensitive catch. The seal can be opened by one leg of the hasp being cut. A product based on the design of WO-A-97/48603 is manufactured and sold by ITW Envopak under the name "Padseal" (registered trade mark). This product has a J-shaped hasp with parallel arms which are inserted into slots within the seal housing. The arms are locked within the housing by means of a sprung catch. The hasp is removed by one leg being cut, the lower part of that leg then being pulled out of the bottom of the housing, which allows the remained of the hasp to be removed from the top.

SUMMARY OF THE INVENTION

It is one object of the invention to provide a seal of the above mentioned type which has a high degree of security and tamper evidence.

According to a first aspect of the invention, there is provided a seal of the type comprising a housing and a J- or U-shaped hasp, the housing having first and second openings to receive the legs of the hasp, the first opening communicating with a third opening of the housing to form a channel for a first leg of the hasp, a locking mechanism being provided within the housing which is biased to resist withdrawal of the first leg of the hasp through the first opening, the hasp being lockable within the housing such that it can only be removed by cutting of the first leg of the hasp, characterised in that the legs of the hasp are substantially rigid and are connected together by a resilient hinge such that in a first, relaxed position the legs adopt a position in which they are not parallel, the legs being moveable to a second, parallel position against the resilient force of the hinge for insertion into the housing.

One advantage of the invention is that on breakage or cutting of the hasp, one leg will spring away from the parallel position which it adopts for insertion into the housing. This spring force makes it more difficult to tamper with the hasp and then seek to reconnect the broken leg parts. Furthermore, the fact that the hasp has been broken and the seal is thus no longer secure is immediately evident because the hasp adopts a different shape than in its locked condition.

Preferably, the hasp is formed as a unitary member and of a material which is substantially rigid but which can form a living, resilient hinge at the juncture between the legs of the hasp.

Another preferred feature is that a point of weakening is provided in the first leg of the hasp, which extends fully through the leg, the hasp being designed to be broken at this point of weakening. This preferred feature further increases security, in that it is more difficult to rejoin the broken legs of the hasp without the join being obvious to an observer.

According to another aspect of the invention, there is provided a seal of the type comprising a housing and a J- or U-shaped hasp, the housing having first and second openings to receive the legs of the hasp, the first opening communicating with a third opening of the housing to form a channel for a first leg of the hasp, a locking mechanism being provided within the housing which is biased to resist withdrawal of the first leg of the hasp through the first opening, the hasp being lockable within the housing such that it can only be removed by cutting of the first leg of the hasp, characterised in that the housing is formed of a main body and a cover, the cover being sealed onto the body part, the cover having at least one protrusion which engages in a corresponding recess within the body part, the protrusion having an aperture therethrough which in use receives one leg of the hasp.

Preferably, the cover has two apertures which may be through separate protrusions, so that both legs of the hasp are received through apertured parts of the cover when the seal is in its locked position.

One advantage of the second aspect of the invention is that the seal housing is more tamper-proof. The seal cover cannot easily be removed from the housing body, when the seal is in the locked condition, because the legs of the hasp hold the cover on the body, in addition to the normal seals which are used to bond the parts of the housing together.

For the avoidance of any doubt, the first and second aspects of the invention can be used together.

BRIEF DESCRIPTION OF THE DRAWINGS

Further advantages of the invention will be understood from the filing detailed description of preferred embodiments that the invention, which are described below, by example only, with reference to the accompanying figures. In the drawings.

DETAILED DESCRIPTION OF PREFERRED EMBODIMENTS

Figure 1A:
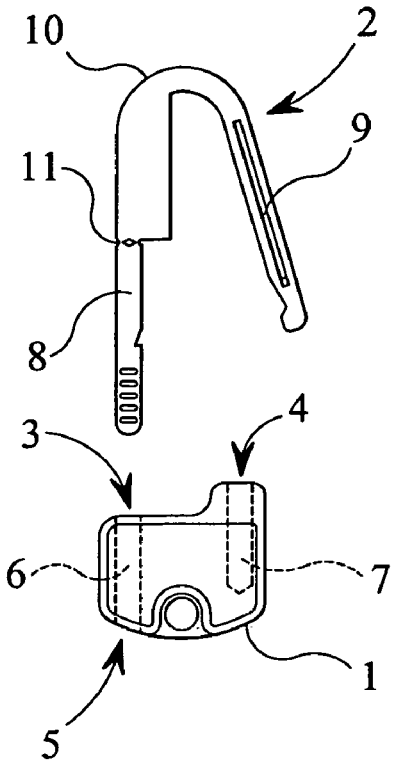
FIGS. 1A to 1E show a first embodiment of the invention, the different figures showing the connection and removal of the hasp in the seal body.

As shown in FIG. 1A, the seal comprises as seal housing (1) and a hasp (2). The housing has first and second openings (3, 4), the first opening (4) communicating with a third opening (5) at the opposite side of the housing to form a passage or channel (6). The second opening (4) communicates with a blind bore or passage (7). The passage (6) and passage (7) are substantially parallel to one another, within the housing body.

The hasp is U- or J-shaped and in the embodiment shown has a longer leg (8) and a shorter leg (9). At the juncture of the legs (8, 9) is a resilient hinge (10). In this embodiment, the hasp is formed of a suitably stiff yet resilient plastics material (for example acetal, nylon, styrene, ABS, PP or PE) such that the legs are substantially rigid yet can be flexed towards or away one another. A weakened point (11) is formed in leg (8). Leg (8) has a notch (29) and leg (9) has a notch (30). The hasp may, for example, be 6.5 mm by 3.5 mm in its maximum dimensions, and 2 mm thick.

As illustrated, legs (8, 9) in the relaxed condition assume a position relative to one another such that they are not parallel. In the preferred example illustrated, the legs diverge or are splayed, that is they open away from each other away from the hinge. The resilience of the hinge is such that the legs can, however, be squeezed together so that they adopt a parallel orientation.

Figure 1B:
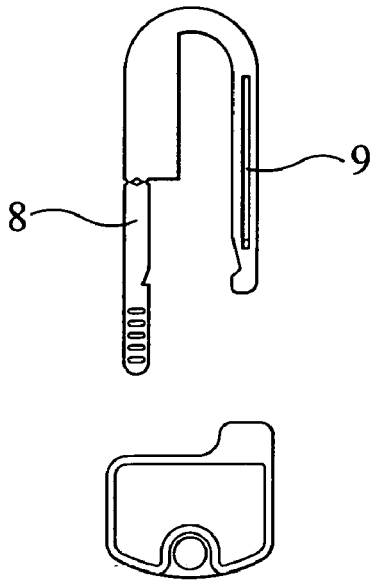
Figure 1C:
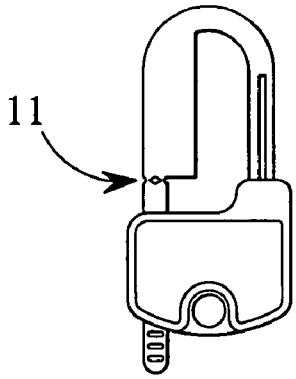
Figure 1D:
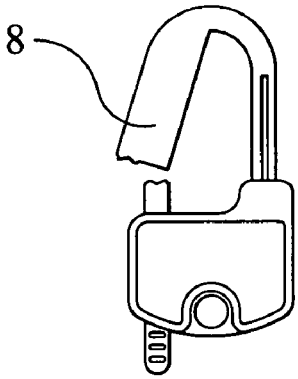

The parallel condition of the legs (8, 9) as seen in FIG. 1B. With the legs parallel, they are able to be engaged in the housing body, leg (8) passing through passage (6) and leg (9) passing into passage (7). This position is seen in FIG. 1C. The locking of the hasp within the housing will be explained in more detail below, with reference to FIGS. 2A to 2H.

Thus, FIG. 1C shows the locked position of the seal. In practice, the hasp will of course be fitted over the element to be locked. To open the seal, the hasp is broken or cut at weakened point (11). Because of the resilience of the hinge (10), the legs of the hasp will now move apart and in, particular the upper part of leg (8) will move away from leg (9). It is thus immediately obvious that the hasp has been broken and thus that the seal is no longer secure.

Figure 1E:
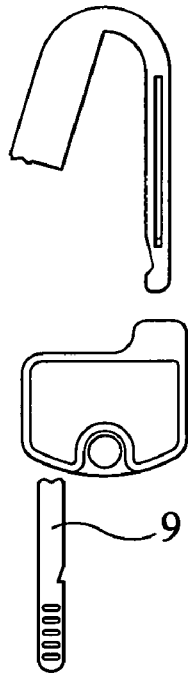

The hasp is removed entirely from the housing, as shown in FIG. 1E, by means of the lower part of leg (8) being pulled out of the bottom of passage (6). The remainder of the hasp can then be pulled out from the top of the housing—this is described in more detail below. The seal can now be re-use with a new hasp, which in practice will have a new identification code thereon for increased security. The removal of the hasp from the seal is done in the same manner as is known from the existing "Padseal" product (Registered trade mark).

FIGS. 2A to 2H are similar to FIGS. 1A to 1E, except that the inside of the seal housing (1) is visible. In practice, the housing is formed of a main body part (20) and a cover (not seen in FIGS. 2A to 2H) which is sealed onto the housing body in a known fashion. Typically, the cover would be welded on the housing body, pins on the cover locating within corresponding recesses in the housing body.

Within the seal housing is an angled, resilient catch member (21) which has arms (22, 23) which join at a curved juncture (24) and extend away from each other from this juncture to form an 'A' shape. The housing body (20) is moulded so as to create the first passage (6) and the passage (7) described with reference to FIG. 1A. In addition, the body has a groove (25) to receive the catch (21). A supporting portion (26) forms a fulcrum on which the catch (21) can rock, the groove (25) being shaped to allow the arms (22, 23) to move as the catch rocks. The supporting part (26) also has a lateral recess (27) in which is fitted a spring (28), this spring forcing the arm (22) of the catch into the passage (6). In this position of arm (22), the arm (21) of the catch does not enter into passage (7).

Figure 2A:
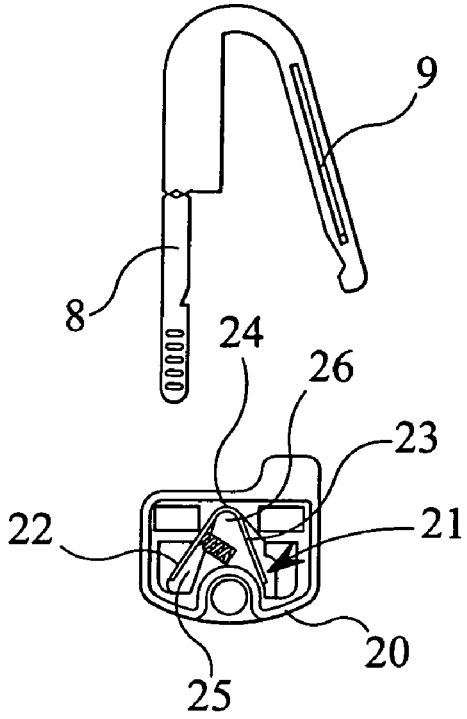
FIGS. 2A to 2H are similar to the views of 1A to 1E, except that the inside of the housing body is visible.
Figure 2B:
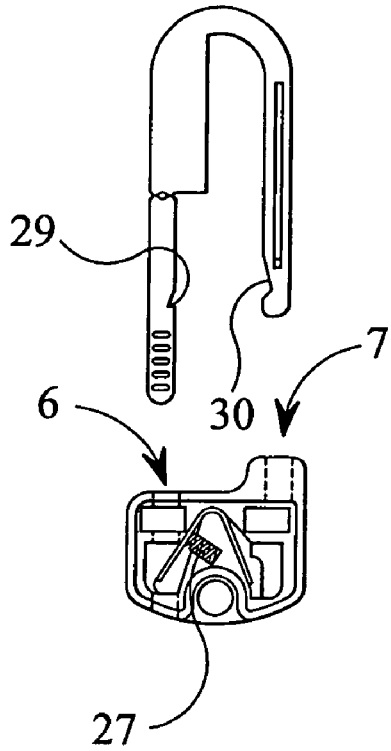
Figure 2C:
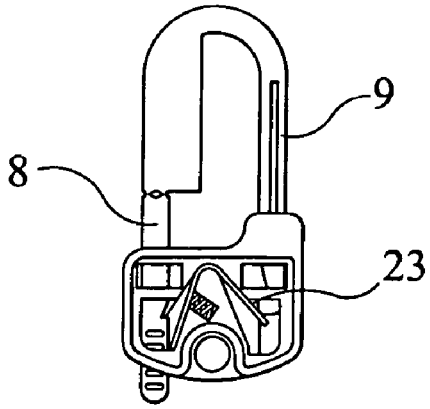
Figure 2D:
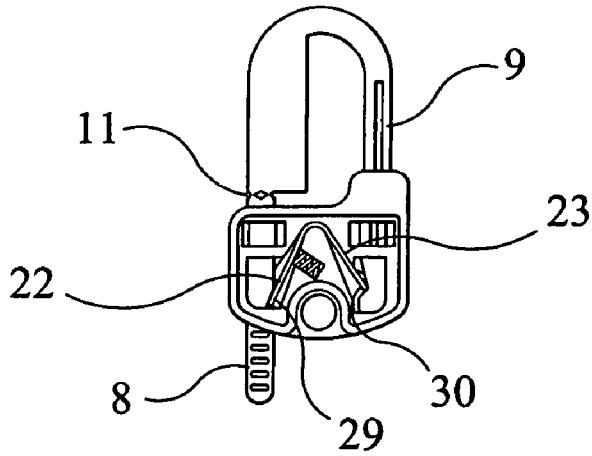

After the legs of the hasp are squeezed together so that they are parallel (as shown in FIG. 2B), the hasp is inserted into the seal housing as shown in FIG. 2C. Because leg (8) is longer than leg (9), this leg (8) will push arm (22) of catch (21) against spring (27), forcing arm (23) of catch (21) into passage (7), as shown in FIG. 2C. However, on further insertion of the hasp into the seal, as shown in FIG. 2D, the spring (28) forces arm (22) of catch (21) into notch (29) of leg (8) of the hasp. Arm (22) of catch (21) cannot now move to its outermost position, because of the presence of leg (8) of the hasp, and so arm (23) of catch (21) extends partly into passage (7) and engages in notch (30) of leg (9) of the hasp.

In this position, the hasp is locked within the seal body. In particular, the hasp cannot be pulled out of the seal body in the direction it was inserted, because the arms of catch (21) are engaged in the notches of both legs of the hasp.

Figure 2E:
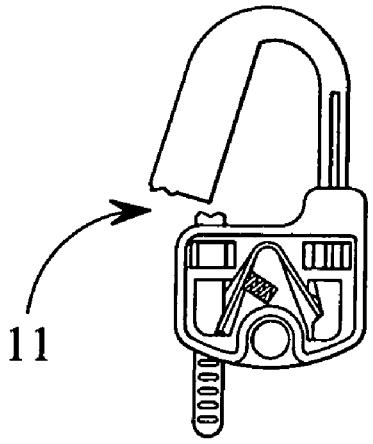
Figure 2F:
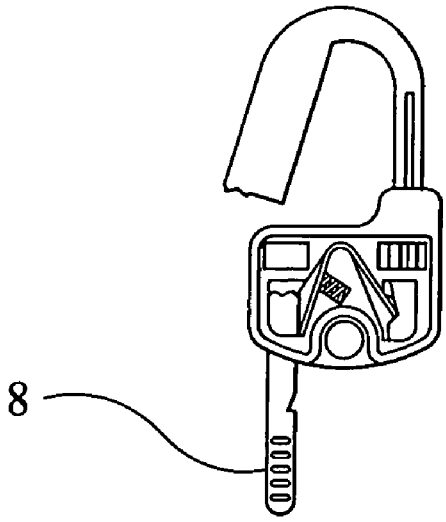
Figure 2G:
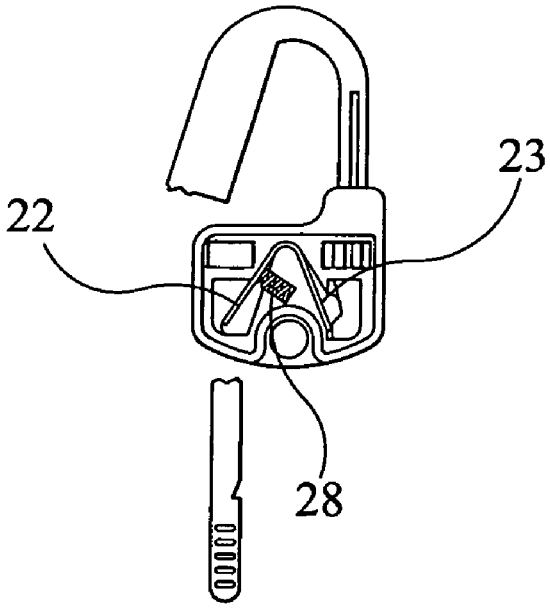
Figure 2H:
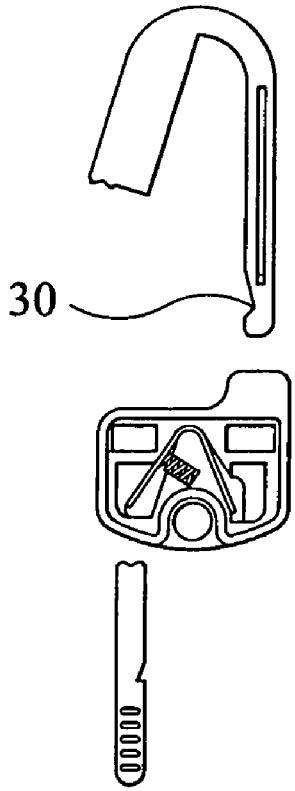

Upon breakage at the point of weakness (11), as seen in FIG. 2E, the lower part of leg (8) of the hasp is disconnected from the upper part. The lower part of leg (8) can be pulled out from the bottom of the seal body, as shown in FIGS. 2F and 2G, the leg passing over and depressing the end of leg (22) of the catch. It will be understood that passage (6) of the seal housing is again empty, as shown in FIG. 2G. This means that arm (22) of the catch (21) can be moved fully by spring (28) into passage (6). This in turn releases arm (23) of catch (21) from passage (7). The top part of the hasp, with the legs (8,9) splayed apart, can now be pulled out from the top of the housing as seen in FIG. 2H. For the avoidance of any doubt, we confirm this removal process is known, except that in known hasps the legs to not splay after breakage of the hasp shown in FIG. 2E.

Figure 3A:
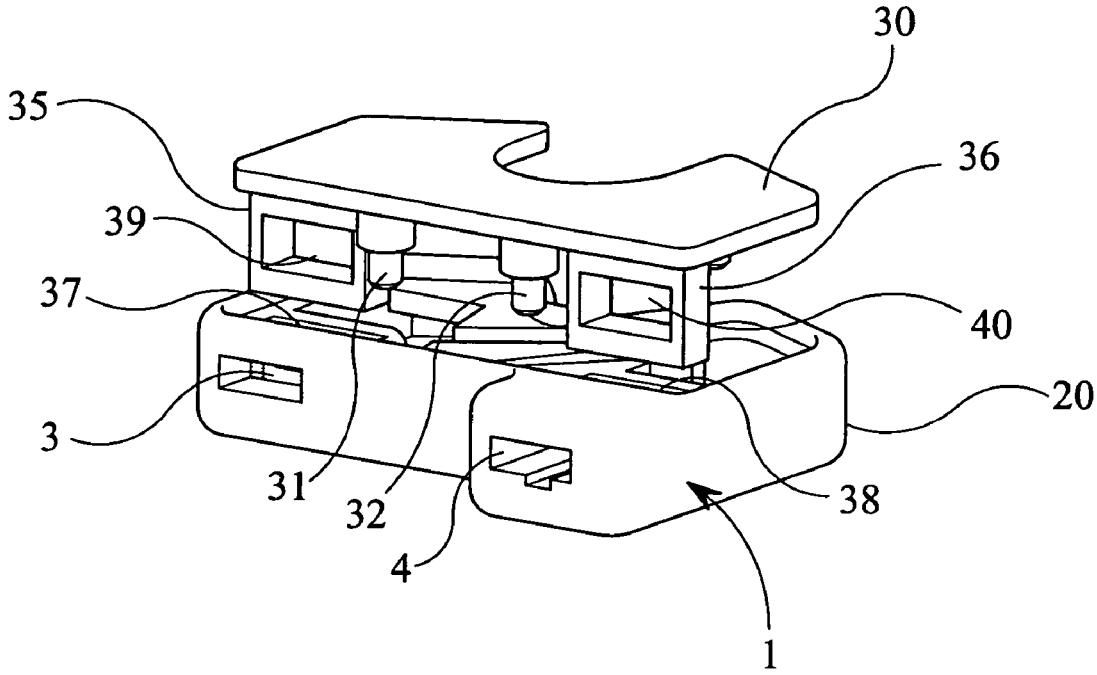
FIGS. 3A and 3B show an embodiment of the second aspect of the invention, wherein the seal has a cover with at least one apertured protrusion.
Figure 3B:
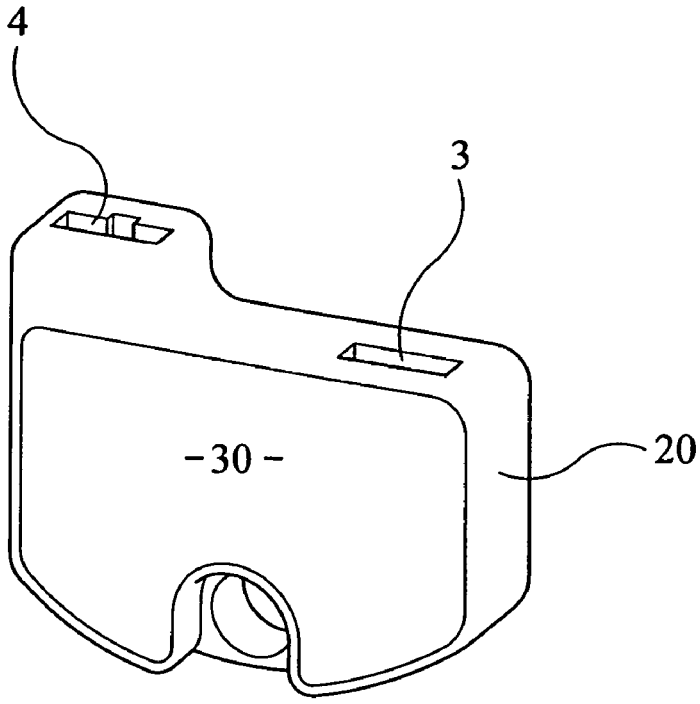

FIGS. 3A and 3B illustrate another aspect of the invention, FIG. 3A being a perspective view of the seal with the cover off and FIG. 3B showing the cover on. Cover (30) is fitted on to seal housing body (20) in order to close the housing. Pins (31, 32) on the cover engage in recesses (not seen) in the body (20) and the cover can be welded onto the housing body in a known fashion (other pins may be included, but are not fully visible in FIG. 3A).

In addition to the pins, or in an alternative embodiment instead of the pins, the cover (30) includes protrusions (35, 36) which in this example are square or rectangular. These protrusions engage in correspondingly shaped recesses (37, 38) in the housing body. The recesses (37, 38) interrupt passages (6, 7) in the housing body.

The protrusions (35, 36) are formed with apertures (39, 40) such that when the cover is fitted on to the seal body, the apertures are in registration with passages (6, 7) and thus form part of the seats for the legs (8, 9) of the hasp. This means that when the seal is locked, with the hasp engaged in the housing, the cover will be physically held onto the housing body not only by its normal connection (gluing, welding, or mechanical fix, etc.) but by the arms of the hasp itself. This means that removal of the cover for unwanted tampering is prevented.

The seal body and cover described above can be used with a flexible hasp as described in relation to FIGS. 1 and 2, or with a rigid hasp formed, for example, of rigid plastics or of metal.

The invention claimed is:

1. A security seal, comprising a housing and a hasp;

the housing having first and second openings to receive first and second legs of the hasp, the first opening communicating with a third opening of the housing to form a channel for the first leg of the hasp;

a locking mechanism being provided within the housing wherein said locking mechanism is biased to resist withdrawal of the first leg of the hasp through the first opening, the hasp being lockable within the housing by said locking mechanism, wherein the housing comprises a main body and a cover, the main body includes a first side on which the first and second openings are located;

a second side on which the third opening is located, said first and second sides are opposite to each other;

a third side having a fourth opening sealed by the cover, said third side is perpendicular to the first and second sides;

the cover has at least two protrusions each of which is engaged in a corresponding recess provided inside the main body, each of the protrusions being perpendicular to the third side and having therethrough an aperture that is opened in a direction in which a respective one of the legs of the hasp is insertable through said aperture when the hasp is locked within the housing by said locking mechanism; and the locking of the hasp within the housing by said locking mechanism prevents a retraction of the cover from the main body.

2. A security seal according to claim 1, wherein the hasp is a unitary member formed of a material which is substantially rigid at the legs and forms a resilient hinge at a juncture between the legs of the hasp.

3. A security seal according to claim 1, wherein a point of weakening is provided in the first leg of the hasp and extends fully through a thickness of the leg, the hasp being breakable at the point of weakening.

4. A security seal according to claim 1, wherein said protrusion extends substantially perpendicular to the cover.

5. A security seal according to claim 1, wherein the aperture of one of the protrusions is aligned with the first opening and the third opening and the aperture of the other protrusion is aligned with the second opening.

6. A security seal, comprising a housing and a hasp insertable into said housing;

said hasp including a first leg and a second leg, said first and second legs having first and second locking elements, respectively;

wherein said housing comprises:

a first opening though which said first leg of the hasp is passable into the housing;

a second opening through which said second leg of the hasp is passable into the housing;

a third locking element moveable between a first position and a second position, said third locking element being biased towards the first position, wherein in the first position, the third locking element is not engageable with the second locking element of the second leg regardless of a relative position of the second leg and the housing, said third locking element is moveable to the second position by the first leg when the first leg is introduced in the housing, and in the second position, the third locking element is engageable with the second leg.

7. A security seal according to claim 6, wherein each of the first and the second locking elements is a notch and the third locking element of said housing is an angled catch member having a first arm and a second arm joined at a juncture, said first and second arms being configured to engage the first and second locking elements, respectively, when the third locking element is in the second position.

8. A security seal according to claim 6, wherein, when the first leg and the second leg are parallel, said first locking element of the first leg and said second locking element of the second leg face each other.

9. A security seal according to claim 6, wherein the legs of the hasp are connected together by a resilient hinge such that in a relaxed position the legs are not parallel, the legs being moveable to a parallel position against a resilient force of the hinge for insertion into the housing.

10. A security seal according to claim 9, wherein the hasp including the legs and the hinge, is a unitary member formed of a material which is substantially rigid at the legs and forms the resilient hinge at a juncture between the legs of the hasp.

11. A security seal according to claim 9, wherein a point of weakening is provided in the first leg of the hasp and extends fully through a thickness of the leg, the hasp being breakable at the point of weakening.

12. A security seal according to claim 9, wherein the legs of the hasp in the relaxed position diverge.

13. A security seal according to claim 6, wherein, in a locked position when the hasp is locked in the housing by the third locking element engaging the first and second locking elements, an exposed portion of said first leg is located past a third opening of said housing and accessible by a user to enable the user to pull said exposed portion in a direction away from said housing when the first leg is broken.

14. A security seal according to claim 13, wherein, in the locked position, said third locking element does not resist movement of said exposed portion of the first leg through the third opening.

15. A security seal according to claim 14, wherein said first leg has a first portion having a first width and a second portion having a second width, wherein said first width is greater than the second width to define a shoulder at a junction of said first and second portions; and a point of weakening that connects the first and the second portions of the first leg of the hasp;

wherein the movement of said exposed portion of the first leg though the third opening is limited by said shoulder.

* * * * *